US012070785B2

(12) United States Patent
Kong

(10) Patent No.: US 12,070,785 B2
(45) Date of Patent: Aug. 27, 2024

(54) HOT-STAMPED PART

(71) Applicant: Hyundai Steel Company, Incheon (KR)

(72) Inventor: Je Youl Kong, Incheon (KR)

(73) Assignee: Hyundai Steel Company, Incheon (KR)

( * ) Notice: Subject to any disclaimer, the term of this patent is extended or adjusted under 35 U.S.C. 154(b) by 0 days.

(21) Appl. No.: 18/153,697

(22) Filed: Jan. 12, 2023

(65) Prior Publication Data

US 2023/0148259 A1 May 11, 2023

Related U.S. Application Data

(62) Division of application No. 17/109,981, filed on Dec. 2, 2020, now Pat. No. 11,583,909.

(30) Foreign Application Priority Data

Dec. 20, 2019 (KR) ..... 10-2019-0171792
Sep. 10, 2020 (KR) ..... 10-2020-0116097

(51) Int. Cl.
*B21D 22/02* (2006.01)
*C22C 38/00* (2006.01)
(Continued)

(52) U.S. Cl.
CPC ..... *B21D 22/022* (2013.01); *C22C 38/001* (2013.01); *C22C 38/002* (2013.01);
(Continued)

(58) Field of Classification Search
CPC ..... B62D 29/00; B62D 29/007; B62D 25/04
See application file for complete search history.

(56) References Cited

U.S. PATENT DOCUMENTS 9,631,248 B2 4/2017 Hwang et al.
10,286,439 B2 5/2019 Jin et al.
10,399,519 B2 * 9/2019 Sohmshetty ..... B21D 53/88
10,633,037 B2 * 4/2020 Baccouche ..... C21D 8/0294
(Continued)

FOREIGN PATENT DOCUMENTS

CN 101806541 A 8/2010
DE 102017202377 A1 8/2018
(Continued)

OTHER PUBLICATIONS

Office Action issued Dec. 2, 2022 in Chinese Patent Application No. 202080041159.1 (English language translation provided).
(Continued)

*Primary Examiner* — Sarang Afzali
(74) *Attorney, Agent, or Firm* — Fox Rothschild LLP

(57) ABSTRACT

A hot-stamped part is manufactured from a blank using a manufacturing method that includes inserting a blank into a heating furnace. The heating furnace includes heating sections and soaking sections. The blank passes through the heating sections, and through the soaking sections at a temperature of Ac3 to 1,000° C. In the step of heating the blank, a temperature condition in the heating furnace satisfies formula $0<(Tg-Ti)/Lt<0.025°$ C./mm, wherein Tg denotes a soaking temperature (° C.), Ti denotes an initial temperature (° C.) of the heating furnace, and Lt denotes a length (mm) of the heating sections. An amount of diffusion hydrogen of the hot-stamped part is less than 0.45 ppm and a corrosion rate of the hot-stamped part measured through a copper potential polarization test is less than or equal to $3\times10^{-6}$ A.

4 Claims, 10 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/28*** | (2006.01) |
| ***C22C 38/32*** | (2006.01) |

(52) U.S. Cl.

CPC ..... *C22C 38/02* (2013.01); *C22C 38/04* (2013.01); *C22C 38/06* (2013.01); *C22C 38/22* (2013.01); *C22C 38/28* (2013.01); *C22C 38/32* (2013.01)

(56) References Cited

U.S. PATENT DOCUMENTS

| | | | | |
|---|---|---|---|---|
| 11,148,725 | B2 * | 10/2021 | Singh | B29C 71/02 |
| 2010/0086002 | A1 | 4/2010 | Hwang et al. | |
| 2010/0221572 | A1 | 9/2010 | Laurent et al. | |
| 2010/0258216 | A1 | 10/2010 | Wu et al. | |
| 2016/0222485 | A1 | 8/2016 | Murakami et al. | |
| 2018/0044774 | A1 | 2/2018 | Allely et al. | |
| 2020/0385836 | A1 | 12/2020 | Yi et al. | |
| 2021/0155996 | A1 | 5/2021 | Winkel et al. | |

FOREIGN PATENT DOCUMENTS

| | | | |
|---|---|---|---|
| DE | 102017110864 | B3 | 10/2018 |
| DE | 102017120128 | A1 | 3/2019 |
| EP | 1830147 | A1 | 9/2007 |
| EP | 3184655 | A1 | 6/2017 |
| JP | 2006289425 | A | 10/2006 |
| KR | 10-2011-0038763 | A | 4/2011 |
| KR | 10-1360661 | B1 | 2/2014 |
| KR | 10-1827188 | B1 | 2/2018 |
| KR | 10-2018-0095757 | A | 8/2018 |
| WO | 2019043161 | A1 | 3/2019 |
| WO | 2019205698 | A1 | 10/2019 |

OTHER PUBLICATIONS

Decision to Revoke Patent (Decision on Patent Opposition) issued Mar. 21, 2023 in corresponding Korean Patent No. 10-2315388.

K.S. Jhajj, "Heat Transfer Modeling of Roller Hearth and Muffle Furnace", A thesis presented to the University of Waterloo, Waterloo, Ontario, Canada, 2015.

K.S. Jhaj et al., "Inferring the specific heat of an ultra high strength steel during the heating stage of hot forming die quenching, through inverse analysis", Applied Thermal Engineering, vol. 83, pp. 98-107 (2015).

S. Klimek et al., "Simulation of Spot Welds and Weld Seams of Press-Hardened Steel (PHS) Assemblies", LS-DYNA Anwenderforum, Bamberg 2008—Crash I—Verbindungstechnik.

A. Belhadj, "Latest 3rd GEN AHSS and 2nd GEN Press Hardened Steels: solutions to new automotive challenges", Automotive Connection 2019, Oct. 9-10, 2019, St. Quentin En Yvelines, 29 pages.

* cited by examiner

HOT-STAMPED PART

CROSS-REFERENCE TO RELATED APPLICATIONS

This application is a Division of U.S. patent application Ser. No. 17/109,981, filed on Dec. 2, 2020, which claims under 35 U.S.C. § 119 the benefit of Korean Patent Application No. 10-2019-0171792, filed on Dec. 20, 2019, and Korean Patent Application No. 10-2020-0116097, filed on Sep. 10, 2020, the entire contents of which are incorporated by reference herein.

BACKGROUND

1. Technical Field

The present disclosure relates to a hot-stamped part and a method of manufacturing the same.

2. Description of Related Art

As environmental regulations and fuel economy-related regulations are strengthened around the world, the need for lighter vehicle materials is increasing. Accordingly, research and development on ultra-high strength steel and hot-stamped steel are being actively conducted. A hot stamping process is generally composed of heating/molding/cooling/trimming operations, and uses a phase transformation of materials and a change in microstructures during the processes.

Recently, studies have been actively conducted to improve delayed fracture, corrosion resistance, and weldability occurring in hot-stamped parts that are manufactured using the hot stamping process.

SUMMARY

Embodiments of the present disclosure provide a hot-stamped part and a method of manufacturing the same, in which, even when at least two blanks, tailor-welded blanks, or tailor-rolled blanks, which are different in at least one of a thickness or a size, are simultaneously heated in a heating furnace, a difference in quality between blanks may be prevented or minimized (i.e., significantly reduced).

Additional aspects will be set forth in part in the description which follows and, in part, will be apparent from the description, or may be learned by practice of the presented embodiments of the disclosure.

According to an embodiment of the present disclosure, a method of manufacturing a hot-stamped part includes: inserting a blank into a heating furnace including a plurality of sections with different temperature ranges; step heating the blank in multiple stages; and soaking the blank at a temperature of about Ac3 to about 1000° C., wherein in the step of heating the blank, a temperature condition in the heating furnace satisfies the following equation: $0<(Tg-Ti)/Lt<0.025°$ C./mm, where Tg denotes a soaking temperature (° C.), Ti denotes an initial temperature (° C.) of the heating furnace, and Lt denotes a length (mm) of step heating sections.

According to the present embodiment, among the plurality of sections, a ratio of a length of sections for step heating the blank to a length of a section for soaking the blank may be about 1:1 to 4:1.

According to the present embodiment, at least two blanks (e.g., the blank and an additional blank) having different thicknesses may be simultaneously transferred into the heating furnace.

According to the present embodiment, the blank may include a first portion having a first thickness and a second portion having a second thickness, which is different from the first thickness.

According to the present embodiment, temperatures of the plurality of sections may increase in a direction from an inlet of the heating furnace to an outlet of the heating furnace.

According to the present embodiment, a difference in temperature between two adjacent sections among the plurality of sections for step heating the blank may be greater than 0° C. and less than or equal to 100° C.

According to the present embodiment, among the plurality of sections, a temperature of a section for soaking the blank may be higher than a temperature of other sections for step heating the blank.

According to the present embodiment, the blank may remain in the heating furnace for about 180 seconds to about 360 seconds.

According to the present embodiment, the method may further include: after the soaking, transferring the soaked blank from the heating furnace to a press mold; forming a molded body by hot-stamping the transferred blank; and cooling the formed molded body.

According to the present embodiment, in the transferring of soaked blank from the heating furnace to the press mold, the soaked blank may be air-cooled for about 10 seconds to about 15 seconds.

According to another embodiment of the present disclosure, a hot-stamped part has an amount of diffusion hydrogen less than 0.45 ppm, and a corrosion rate measured through a copper potential polarization test less than or equal to $3\times10^{-6}$ A.

According to the present embodiment, the hot-stamped part may have a tensile strength of between about 500 MPa and 800 MPa, and may have a composite structure of ferrite and martensite.

According to the present embodiment, the hot-stamped part may have a tensile strength of between about 800 MPa and 1,200 MPa, and may have a composite structure of bainite and martensite.

According to the present embodiment, the hot-stamped part may have a tensile strength of between about 1,200 MPa and 2,000 MPa, and may have a composite structure of full martensite.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
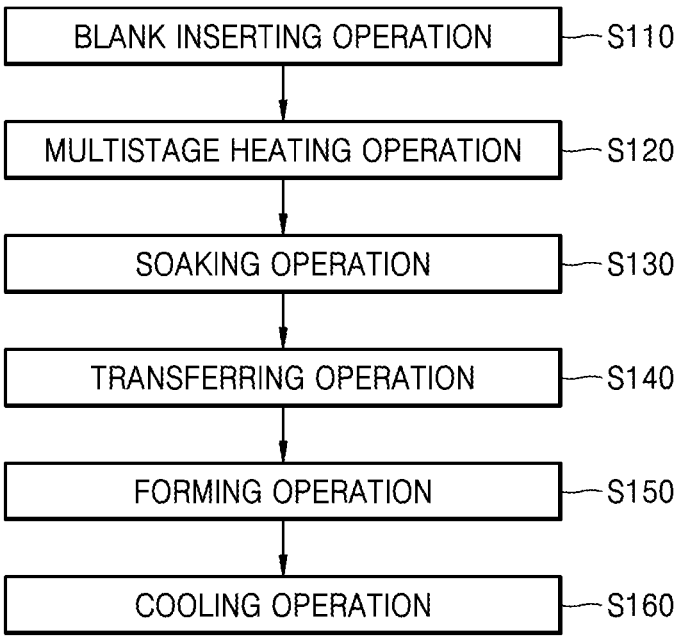
FIG. 1 is a schematic flowchart of a method of manufacturing a hot-stamped part, according to an embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Since the present disclosure may have various modifications and embodiments, specific embodiments are illustrated in the drawings and will be described in detail in the detailed description. The effects and features of the disclosure, and a method to achieve the same will become more apparent from the following embodiments that are described in detail in conjunction with the accompanying drawings. However, the present disclosure is not limited to the following embodiments and may be embodied in various forms.

It will be understood that although the terms "first," "second," etc. may be used herein to describe various elements, these elements should not be limited by these terms. These elements are only used to distinguish one element from another.

It will be understood that when a layer, region, or element is referred to as being "formed on," another layer, region, or element, it can be directly or indirectly formed on the other layer, region, or element. That is, for example, intervening layers, regions, or elements may be present.

Sizes of elements in the drawings may be exaggerated for convenience of description. In other words, because the sizes and thicknesses of elements in the drawings are arbitrarily illustrated for convenience of description, the present disclosure is not limited thereto.

When a certain embodiment may be implemented differently, a specific process order may be performed differently from the described order. For example, two processes described in succession may be performed substantially simultaneously, or may be performed in an order opposite to that described.

The embodiments will now be described more fully with reference to the accompanying drawings. When describing embodiments with reference to the accompanying drawings, the same or corresponding elements are denoted by the same reference numerals.

FIG. 1 is a schematic flowchart of a method of manufacturing a hot-stamped part, according to an embodiment. Herein below, the method of manufacturing a hot-stamped part will be described with reference to FIG. 1.

According to an embodiment of the present disclosure, the method of manufacturing a hot-stamped part may include a blank inserting operation S110, a step heating operation S120, and a soaking operation S130, and may further include, after the soaking operation S130, a transferring operation S140, a forming operation S150, and a cooling operation S160.

First, the blank inserting operation S110 may include inserting a blank into a heating furnace including a plurality of sections with different temperature ranges.

The blank inserted into the heating furnace may be formed by cutting a plate material for forming a hot-stamped part. The plate material may be manufactured by performing hot rolling or cold rolling on a steel slab, and then an annealing heat treatment on the hot-rolled or cold-rolled steel slab. Also, after the annealing heat treatment, an aluminum (Al)-silicon (Si)-based plating layer or zinc (Zn) plating layer may be formed on at least one surface of the annealed and heat-treated plate material.

Figure 2:
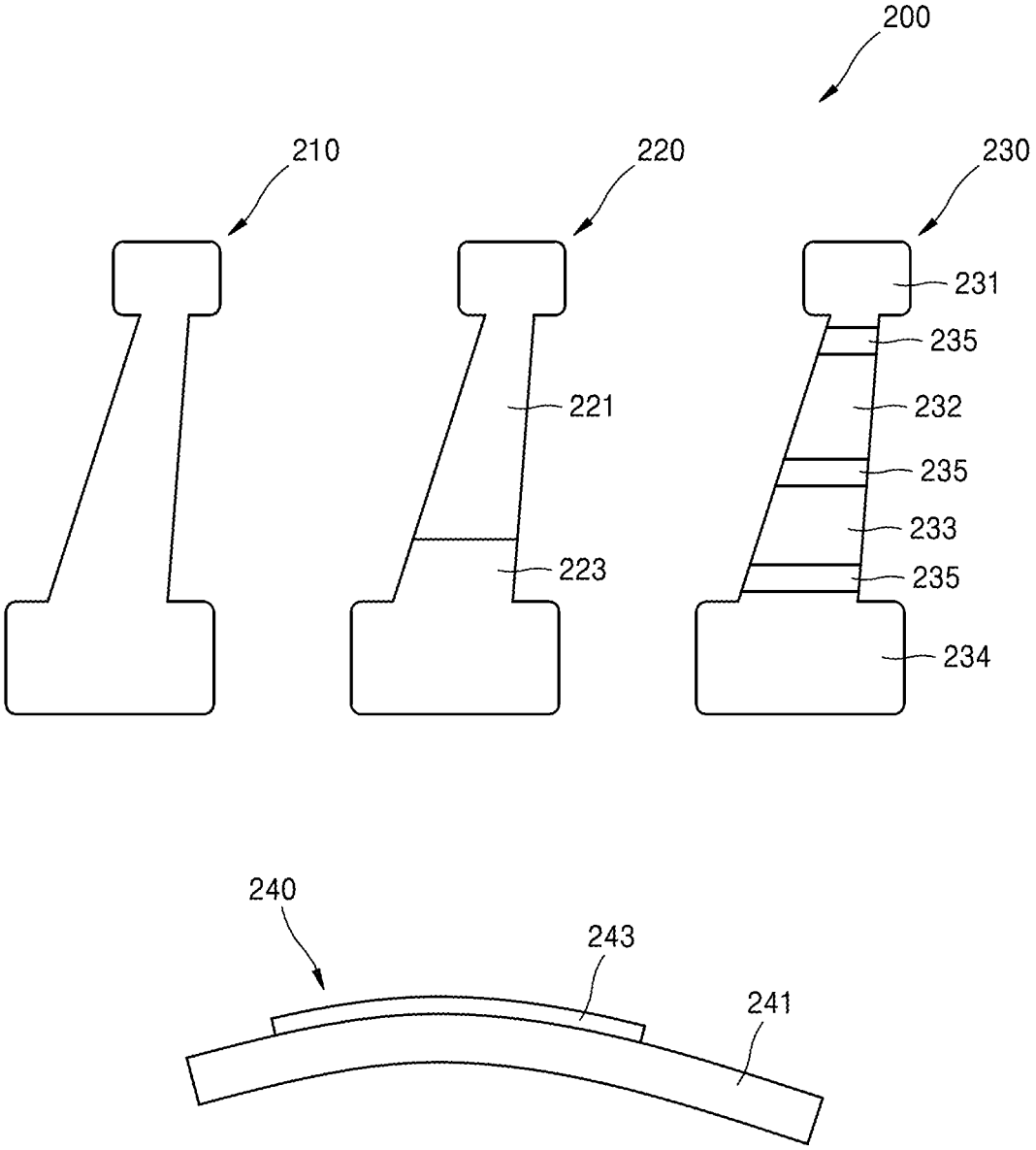
FIG. 2 is a schematic plan view of a blank used in a method of manufacturing a hot-stamped part, according to an embodiment of the present disclosure.

FIG. 2 is a schematic plan view of a blank 200 used in a method of manufacturing a hot-stamped part, according to an embodiment of the present disclosure.

Referring to FIG. 2, the blank 200 according to an embodiment may include at least one of a blank 210 having a uniform thickness, a tailor welded blank (TWB) 220 formed by cutting different types of plate materials having different thicknesses into a required shape and welding the cut plate materials to each other, a tailor rolled blank (TRB) 230 having partially different thicknesses obtained by rolling a plate material having a uniform thickness, or a patchwork 240 manufactured by welding a small patch blank onto a large blank.

The TWB 220 may be manufactured by welding a first plate material 221 and a second plate material 223 having different thicknesses to each other. A B-pillar, which is an important part for a collision member of a vehicle, is manufactured by welding two plate materials having different strengths to each other while the two plate materials are respectively coupled to a collision support portion in the upper portion of the B-pillar and a shock absorbing portion in the lower portion of the B-pillar, and then molding the welded plate materials. In this regard, a TWB method that is mainly used refers to a series of processes of manufacturing parts by cutting different types of plate materials having different thicknesses, strengths, and materials into a required shape, welding the cut plate materials to each other, and then molding the welded plate materials. A blank having partially different thicknesses is manufactured by welding plate materials having different thicknesses, so that portions of the blank have different characteristics. For example, a 120-200K ultra-high strength plate material is used for the collision support portion in the upper portion of the B-pillar, and a plate material having excellent shock absorption performance is connected to the lower portion of the B-pillar where stress is concentrated, thereby improving shock absorption capacity in case of a vehicle collision.

The TRB 230 may be manufactured by rolling a cold-rolled steel material to have a specific thickness profile, and an excellent effect on weight reduction may be obtained when manufacturing a hot-stamped part using the TRB 230. As an example, the thickness profile may be obtained by performing a general method. For example, when cold rolling the cold-rolled steel material, a reduction ratio may be adjusted to form a TRB 230 including a first region 231 having a first thickness, a second region 232 having a second thickness, a third region 233 having a third thickness, and a fourth region 234 having a fourth thickness. In this regard, the first thickness, the second thickness, the third thickness, and the fourth thickness may be different from each other, and transition sections 235 may be between the first region 231 and the second region 232, between the second region 232 and the third region 233, and between the third region 233 and the fourth region 234, respectively. However, although it is shown in FIG. 2 that the TRB 230 includes the first region 231 to the fourth region 234, the present disclosure is not limited thereto. The TRB 230 may include a first region 231, a second region 232, . . . , and an n-th region.

The patchwork 240 may be manufactured by using a method of partially reinforcing a base material using at least two plate materials, and a patch is bonded to the base material prior to a molding process, and thus the base material and the patch may be simultaneously formed. For example, after a patch 243 having a second size is welded onto a base material 241 having a first size, the second size being less than the first size, the base material 241 and the patch 243 may be simultaneously molded.

Figure 3:
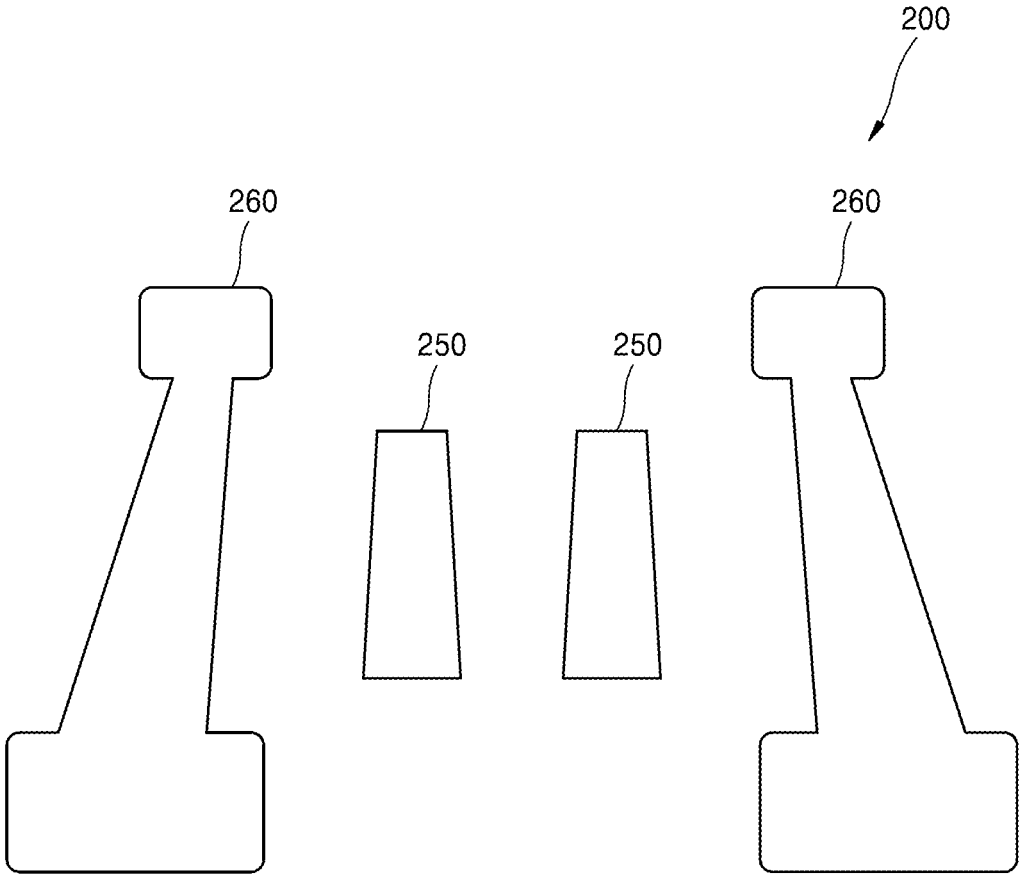
FIG. 3 is a schematic plan view of a blank inserted into a heating furnace, in a method of manufacturing a hot-stamped part according to an embodiment of the present disclosure.

FIG. 3 is a schematic plan view of a blank 200 inserted into a heating furnace, in a method of manufacturing a hot-stamped part according to an embodiment of the present disclosure.

In the blank inserting operation S100, two blanks 200, which are different in at least one of a thickness or a size, may be simultaneously inserted into the heating furnace.

For example, FIG. 3 illustrates two first blanks 250 and two second blanks 260, which all are simultaneously inserted into the heating furnace. In this regard, each of the first blanks 250 may have a different size and a different thickness than those of each of the second blanks 260. For example, each of the first blanks 250 may have a thickness of 1.2 mm, and each of the second blanks 260 may have a thickness of 1.6 mm. However, the present disclosure is not limited thereto, and one first blank 250 and one second blank 260 may be simultaneously inserted into the heating furnace. Also, the first blank 250 and the second blank 260 may be formed to have the same size and different thicknesses, or may have the same thickness and different sizes. However, various modifications may be made.

In another embodiment, in the blank inserting operation S100, at least two blanks 200 having a uniform thickness may be simultaneously inserted into the heating furnace. For example, at least two first blanks 250 each having a thickness of 1.2 mm may be simultaneously inserted, and at least two second blanks 260 each having a thickness of 1.6 mm may be simultaneously inserted. Also, in the blank inserting operation S110, the TWB 220 (see FIG. 2) or TRB 230 (see FIG. 2) described above may also be inserted into the heating furnace.

The blanks inserted into the heating furnace may be mounted on a roller and then transferred in a transfer direction.

After the blank inserting operation S110, the step heating operation S120 and the soaking operation S130 may be performed. The step heating operation S120 and the soaking operation S130 may be operations in which the blank is heated while passing through a plurality of sections included in the heating furnace.

In particular, in the step heating operation S120, as the blank passes through the sections provided in the heating furnace, the temperature of the blank may be raised in stages. There may be a plurality of sections in which the step heating operation S120 is performed, among the sections provided in the heating furnace, and the temperature is set for each section so as to increase in a direction from an inlet of the heating furnace into which the blank is inserted to an outlet of the heating furnace from which the blank is discharged, and thus the temperature of the blank may be raised in stages.

The soaking operation S130 may be performed, followed by the step heating operation S120. In the soaking operation S130, the step heated blank may be soaked while passing through a section of the heating furnace set at a temperature of about Ac3° C. to about 1,000° C. Preferably, in the soaking operation S130, the multistage-heated blank may be soaked at a temperature of about 930° C. to about 1,000° C. More preferably, in the soaking operation S130, the step-heated blank may be soaked at a temperature of about 950°

C. to about 1,000° C. Also, among the sections provided in the heating furnace, there may be at least one section in which the soaking operation S130 is performed.

The term "Ac3 temperature" as used herein is a highest or critical temperature at which a ferrite phase of a metal material (e.g., steel) is completely transformed into an austenite phase of the metal material as a temperature rises, e.g., during heating.

Figure 4:
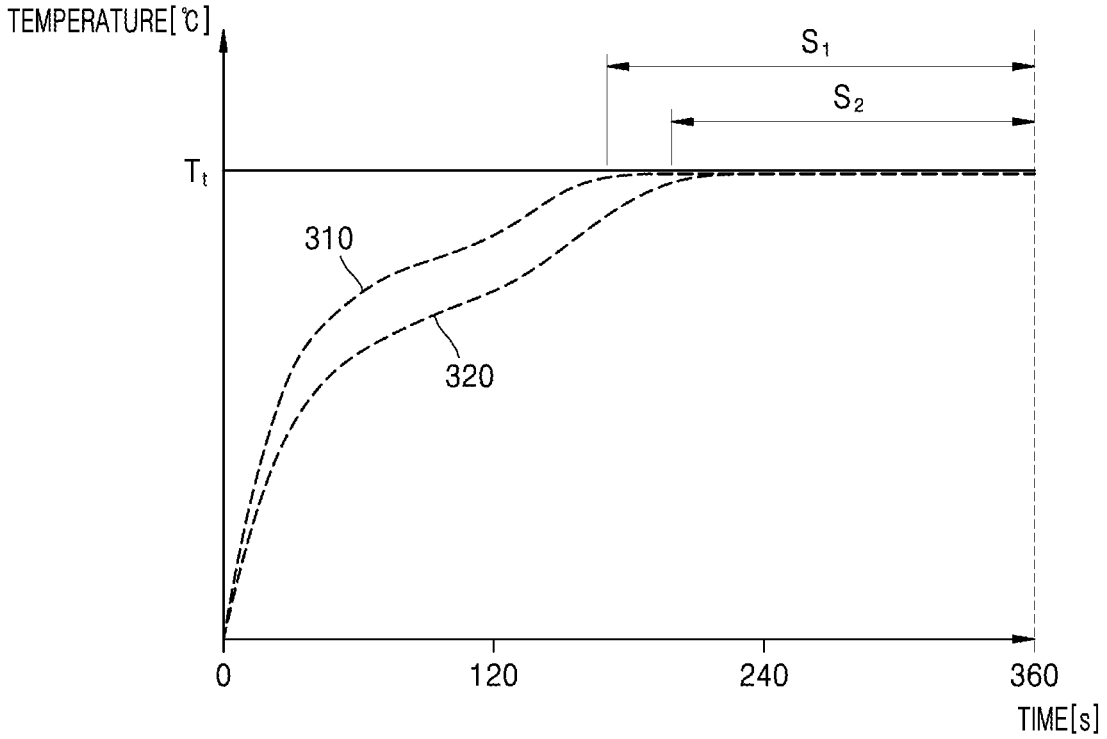
FIG. 4 is a graph of a change in temperature when a blank is heated in a single stage by a method of the related art.

FIG. 4 is a graph of a change in temperature of the blank when a blank is heated at a soaking temperature by a method of the related art. In particular, FIG. 4 is a graph of, in a case where the temperature of the heating furnace is set so that an internal temperature of the heating furnace is maintained equal to a target temperature $T_t$ of the blank, and then a blank having a thickness of 1.2 mm and a blank having a thickness of 1.6 mm are simultaneously heated at a soaking temperature (320), a change in temperature of these blanks over time.

In this regard, the target temperature $T_t$ of the blank may be the Ac3 or higher. Preferably, the target temperature $T_t$ of the blank may be about 930° C. More preferably, the target temperature $T_t$ of the blank may be about 950° C. However, the present disclosure is not limited thereto. Also, the single-stage heating does not mean inserting the blank having a thickness of 1.2 mm and the blank having a thickness of 1.6 mm into the heating furnace and heating the blanks, respectively, but rather means setting the temperature of the heating furnace to a soaking temperature, and then simultaneously inserting the blank having a thickness of 1.2 mm and the blank having a thickness of 1.6 mm into the heating furnace and heating the blanks.

Referring to FIG. 4, when the internal temperature of the heating furnace is set to a temperature equal to the target temperature $T_t$ of the blank, and then the blank having a thickness of 1.2 mm and the blank having a thickness of 1.6 mm are simultaneously heated in a soaking temperature, it may be seen that the blank having a thickness of 1.2 mm reaches the target temperature $T_t$ earlier than the blank having a thickness of 1.6 mm.

That is, as the blank having a thickness of 1.2 mm reaches the target temperature $T_t$ earlier, the blank having a thickness of 1.2 mm may be soaked for a first time period Sm, and the blank having a thickness of 1.6 mm may be soaked for a second time period $S_2$, the second time period being shorter than the first time period Si. Because a period of time for soaking is adjusted based on a blank reaching a target temperature later, the blank having a thickness of 1.2 mm, which has reached the target temperature $T_t$ earlier, may be overheated, and thus an increased risk of delayed fracture and deterioration in weldability of the blank having a thickness of 1.2 mm may be caused.

Figure 5:
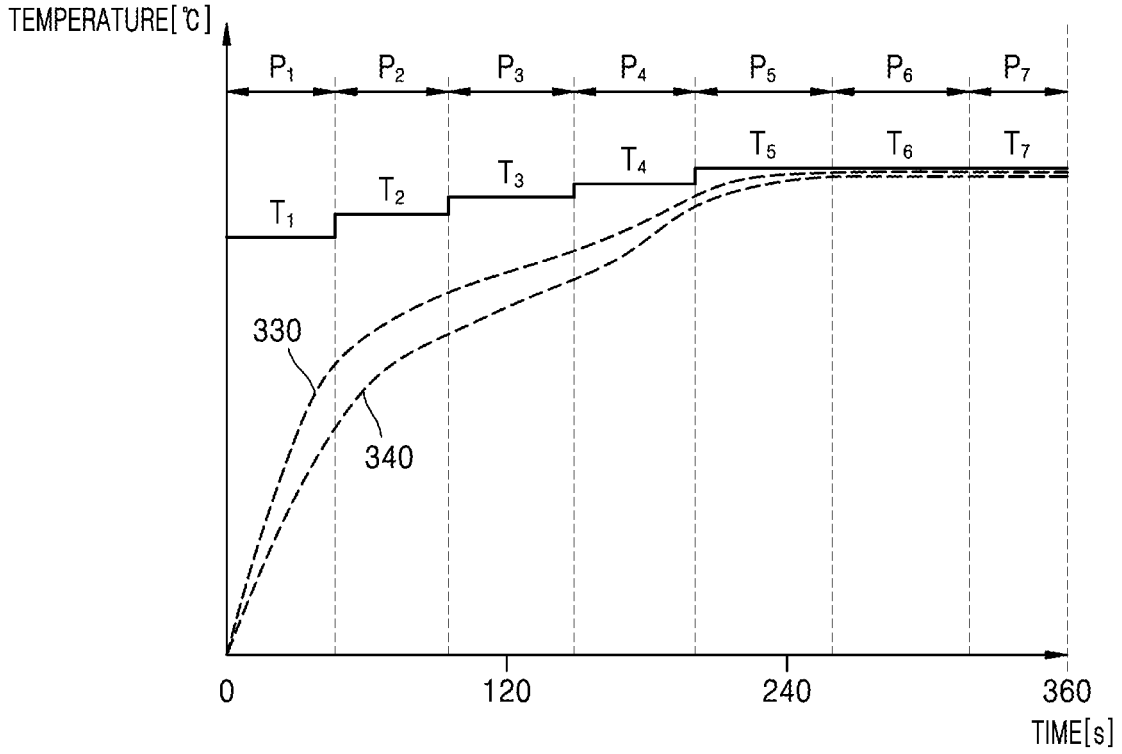
FIG. 5 is a graph of a change in temperature when a blank is step heated, and soaked, in a method of manufacturing a hot-stamped part according to an embodiment of the present disclosure.

FIG. 5 is a graph of a change in temperature when a blank is step heated, and soaked, in a method of manufacturing a hot-stamped part according to an embodiment of the present disclosure. FIG. 5 is a graph of a change in temperature over time when the blank having a thickness of 1.2 mm is step heated (330), and the blank having a thickness of 1.6 mm is step heated (340), according to an embodiment of the present disclosure.

Referring to FIG. 5, the heating furnace according to an embodiment may include a plurality of sections with different temperature ranges. In particular, the heating furnace may include a first section $P_1$ having a first temperature range $T_1$, a second section $P_2$ having a second temperature range $T_2$, a third section $P_3$ having a third temperature range $T_3$, a fourth section $P_4$ having a fourth temperature range $T_4$, a fifth section $P_5$ having a fifth temperature range $T_5$, a sixth section $P_6$ having a sixth temperature range $T_6$, and a seventh section $P_7$ having a seventh temperature range $T_7$.

The first to seventh sections $P_1$ to $P_7$ may be sequentially arranged in the heating furnace. The first section $P_1$ having the first temperature range $T_1$ may be adjacent to the inlet of the heating furnace into which the blank is inserted, and the seventh section $P_7$ having the seventh temperature range $T_7$ may be adjacent to the outlet of the heating furnace from which the blank is discharged. Accordingly, the first section $P_1$ having the first temperature range $T_1$ may be a first section of the heating furnace, and the seventh section $P_7$ having the seventh temperature range $T_7$ may be a last section of the heating furnace. As will be described below, the fifth section $P_5$, the sixth section $P_6$, and the seventh section $P_7$ among the sections of the heating furnace, may not be sections in which step heating is performed, but rather be sections in which soaking is performed.

Temperatures of the sections provided in the heating furnace, for example, temperatures of the first to seventh sections $P_1$ to $P_7$, may increase in a direction from the inlet of the heating furnace into which the blank is inserted to the outlet of the heating furnace from which the blank is discharged. However, temperatures of the fifth section $P_5$, the sixth section $P_6$, and the seventh section $P_7$ may be the same. Also, a difference in temperature between two adjacent sections, among the sections provided in the heating furnace, may be greater than 0° C. and less than or equal to 100° C. For example, a difference in temperature between the first section $P_1$ and the second section $P_2$ may be greater than 0° C. and less than or equal to 100° C.

In an embodiment, the first temperature range $T_1$ of the first section $P_1$ may be about 840° C. to about 860° C., or about 835° C. to about 865° C. The second temperature range $T_2$ of the second section $P_2$ may be about 870° C. to about 890° C., or about 865° C. to about 895° C. The third temperature range $T_3$ of the third section $P_3$ may be about 900° C. to about 920° C., or about 895° C. to about 925° C. The fourth temperature range $T_4$ of the fourth section $P_4$ may be about 920° C. to about 940° C., or about 915° C. to about 945° C. The fifth temperature range $T_5$ of the fifth section $P_5$ may be about Ac3 to about 1,000° C. Preferably, the fifth temperature range $T_5$ of the fifth section $P_5$ may be about 930° C. to about 1,000° C. More preferably, the fifth temperature range $T_5$ of the fifth section $P_5$ may be about 950° C. to about 1,000° C. The sixth temperature range $T_6$ of the sixth section $P_6$ and the seventh temperature range $T_7$ of the seventh section $P_7$ may be the same as the fifth temperature range $T_5$ of the fifth section $P_5$.

Although it is shown in FIG. 5 that the heating furnace according to an embodiment of the present disclosure includes seven sections with different temperature ranges, the present disclosure is not limited thereto. Five, six, or eight sections with different temperature ranges may be provided in the heating furnace.

The blank according to an embodiment may be heated in stages while passing through a plurality of sections defined in the heating furnace. In an embodiment, in a step heating operation in which the blank is heated in multiple stages while passing through the sections in the heating furnace, a temperature condition in the heating furnace may satisfy the following equation:

$$0<(Tg-Ti)/Lt<0.025°\ C./mm \quad \text{<Equation>}$$

where Tg denotes a soaking temperature (° C.), Ti denotes an initial temperature (° C.) of the heating furnace, and Lt denotes a length (mm) of step heating sections.

When a value of the above equation is greater than 0.025° C./mm, the initial temperature of the heating furnace is lowered, so that a heating rate of the blank is lowered, and thus a sufficient period of time for soaking may not be secured. When the heating furnace is operated at a lower driving speed of the roller to secure a sufficient period of time for soaking, deterioration in productivity may be caused. Also, when the value of the above equation is 0° C./mm, as a blank having a small thickness reaches the target temperature Tt earlier as described above with respect to soaking, the blank having a small thickness may be overheated.

Referring to FIGS. 4 and 5, when the blank is step heated in multiple stages while passing through the sections defined in the heating furnace (e.g., the first section P1 to the fourth section P4) and a temperature condition of step heating satisfies the above equation, compared to a case where the blank is heated by soaking, graphs of changes in temperatures of blanks having different thicknesses may exhibit similar curves. For example, when the same period of time elapses after the blank is inserted into the heating furnace, a difference in temperature between blanks when the blank having a thickness of 1.2 mm is step heated (330), and the blank having a thickness of 1.6 mm is step heated (340) may be less than a difference in temperature between blanks when the blank having a thickness of 1.2 mm is heated at a soaking temperature (310), and the blank having a thickness of 1.6 mm is heated at a soaking temperature (320). Therefore, when the blanks are step heated, by controlling heating rates of the blanks having different thicknesses similar to each other, a difference in periods of time for respective blanks to reach a target temperature may be reduced, thereby preventing the blank having a small thickness from being overheated.

The soaking operation S130 may be performed, followed by the step heating operation S120. In the soaking operation S130, the blank may be soaked at a temperature of about 950° C. to about 1,000° C. in a last part of the sections provided in the heating furnace.

The soaking operation S130 may be performed in the last portion of the sections of the heating furnace. As an example, the soaking operation S130 may be performed in the fifth section $P_5$, the sixth section $P_6$, and the seventh section $P_7$ of the heating furnace. When a plurality of sections are provided in the heating furnace and a length of one section is long, there may be a problem such as a change in temperature within the section. Accordingly, the section in which the soaking operation S130 is performed may be divided into the fifth section $P_5$, the sixth section $P_6$, and the seventh section $P_7$, and the fifth section $P_5$, the sixth section $P_6$, and the seventh section $P_7$ may have the same temperature range in the heating furnace.

In the soaking operation S130, the multistage-heated blank may be soaked at a temperature of about Ac3 to about 1,000° C. Preferably, in the soaking operation S130, the multistage-heated blank may be soaked at a temperature of about 930° C. to about 1,000° C. More preferably, in the soaking operation S130, the multistage-heated blank may be soaked at a temperature of about 950° C. to about 1,000° C.

Figure 6:
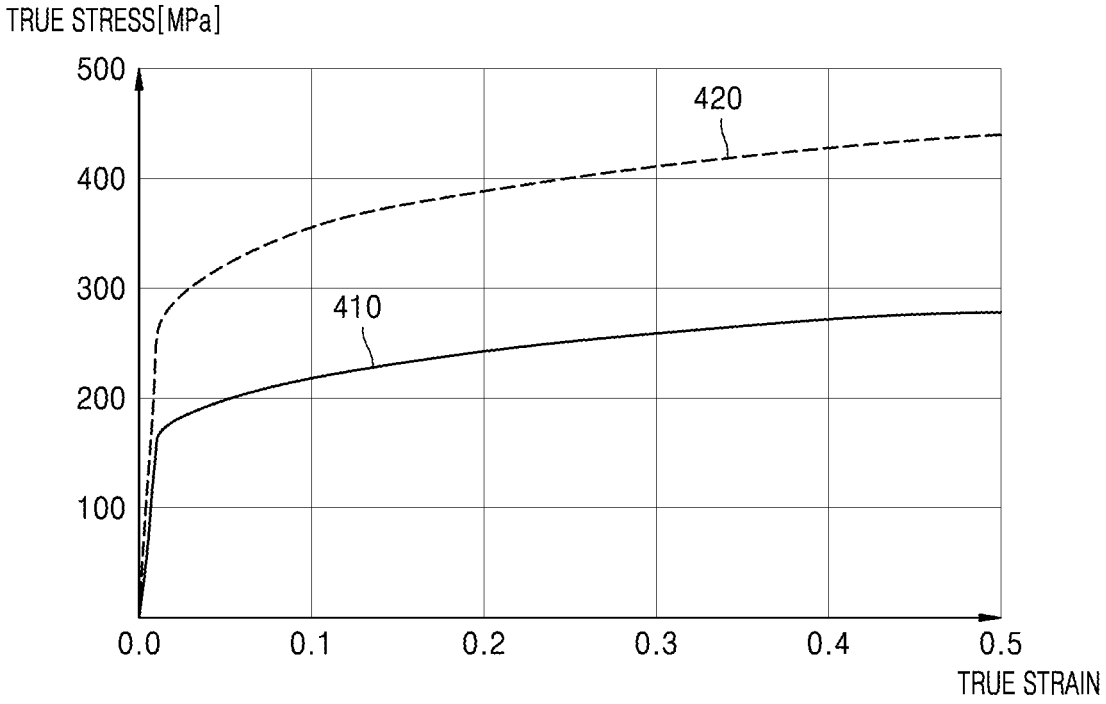
FIG. 6 is a graph of high-temperature tensile properties according to a molding start temperature of a heated blank.

FIG. 6 is a graph of high-temperature tensile properties according to a molding start temperature of a heated blank. FIG. 6 is a graph of a high-temperature tensile test for a blank 410 that is soaked at a temperature of 950° C., taken out, and then air-cooled and exposed for 10 seconds, and a blank 420 that is soaked at a temperature of 900° C., taken out, and then air-cooled and exposed for 10 seconds. In this regard, a molding start temperature of the blank 410 that is soaked at a temperature of 950° C., taken out, and then air-cooled and exposed for 10 seconds is about 650° C. to about 750° C., and a molding start temperature of the blank 420 that is soaked at a temperature of 900° C., taken out, and then air-cooled and exposed for 10 seconds is about 550° C. to about 650° C.

Referring to FIG. 6, it may be seen that the blank 410 that is soaked at a temperature of 950° C. taken out, and then air-cooled and exposed for 10 seconds has true stress lower than that of the blank 420 that is soaked at a temperature of 900° C., taken out, and then air-cooled and exposed for 10 seconds. Accordingly, when a soaking temperature in the heating furnace is lower than 950° C., after a heated blank is taken out from the heating furnace, a press-molding start temperature is excessively lowered by a period of time for air-cooling exposure, and thus an elongation percentage of the heated blank may decrease, thereby causing a thickness reduction or a fracture during a molding operation. Because the heated blank is cooled for the period of time for air-cooling exposure, the strength of the blank is increased, and a great force is required to simultaneously mold a plurality of blanks, so that press equipment may be overloaded. Also, when the soaking temperature is higher than 1,000° C., carbide-forming elements or nitride-forming elements, such as titanium (Ti), vanadium (V), niobium (Nb), molybdenum (Mo), etc. in the blank are dissolved in a base material, which makes it difficult to suppress grain coarsening.

In an embodiment, among the sections in the heating furnace, a temperature of the section for soaking the blank may be higher than or equal to temperatures of the sections for step heating the blank.

In an embodiment, the blank may remain in the heating furnace for about 180 seconds to about 360 seconds. In particular, a period of time for step heating the blank and soaking the blank in the heating furnace may be about 180 seconds to about 360 seconds. When a period of time for the blank to remain in the heating furnace is less than 180 seconds, it may be difficult for the blank to be sufficiently soaked at a desired soaking temperature. Also, when the period of time for the blank to remain in the heating furnace is more than 360 seconds, an amount of hydrogen permeated into the blank increases, thereby leading to an increased risk of delayed fracture and deterioration in corrosion resistance after a hot stamping operation.

Figure 7:
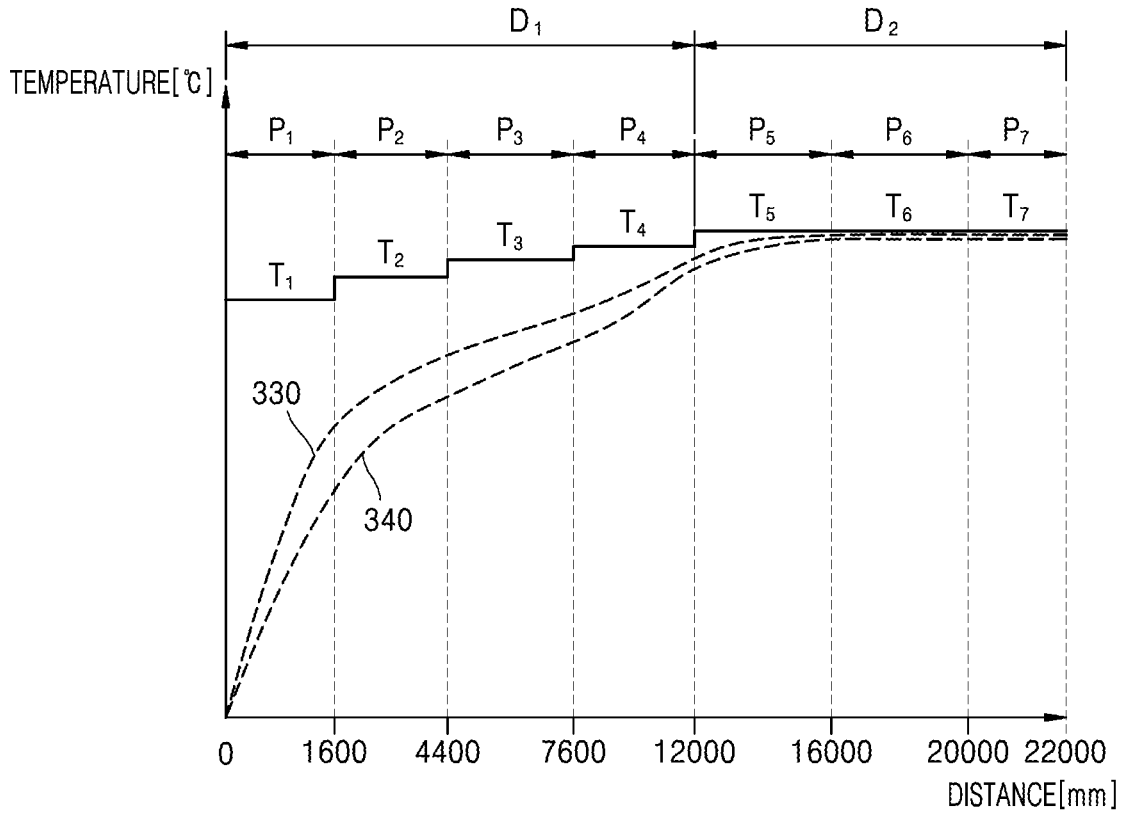
FIG. 7 is a graph of a change in temperature when a blank is step heated, and soaked, in a method of manufacturing a hot-stamped part according to an embodiment of the present disclosure.

FIG. 7 is a graph of a change in temperature when a blank is step heated, and soaked, in a method of manufacturing a hot-stamped part according to an embodiment of the present disclosure. Unlike the graph of FIG. 5, the graph of FIG. 7 illustrates temperatures of blanks according to a distance.

Referring to FIG. 7, in an embodiment, the heating furnace may have a length of about 20 m to about 40 m along a transfer path of the blank. The heating furnace may include a plurality of sections with different temperature ranges, and a ratio of a length $D_1$ of a section for step heating the blank among the sections to a length $D_2$ of a section for soaking the blank among the sections may be about 1:1 to 4:1. For example, the section for soaking the blank among the sections may be a last portion of the heating furnace (e.g., the fifth section $P_5$ to the seventh section $P_7$). When the length of the section for soaking the blank increases, so that the ratio of the length $D_1$ of the section for step heating the blank to the length $D_2$ of the section for soaking the blank is greater than 1:1, an austenite (FCC) structure is generated in the soaking section, which may increase an amount of hydrogen permeated into the blank, thereby increasing the risk of delayed fracture. Also, when the length of the section for soaking the blank decreases, so that the ratio of the length $D_1$ of the section for step heating the blank to the length $D_2$ of the section for soaking the blank is less than 4:1, sufficient sections (periods of time) for soaking are not secured, and thus the strength of a part manufactured by the method of manufacturing a hot-stamped part may be uneven.

In an embodiment, the soaking section among the sections provided in the heating furnace may have a length of about 20% to about 50% of the total length of the heating furnace.

After the soaking operation S130, the transferring operation S140, the forming operation S150, and the cooling operation S160 may be further performed.

The transferring operation S140 may include transferring the soaked blank from the heating furnace to a press mold. In the transferring of the soaked blank from the heating furnace to the press mold, the soaked blank may be air-cooled for about 10 seconds to about 15 seconds.

The forming operation S150 may include forming a molded body by hot-stamping the transferred blank. The cooling operation S160 may include cooling the formed molded body.

A final product may be formed by molding the molded body into a final part shape in the press mold, and then cooling the molded body. A cooling channel through which a refrigerant circulates may be provided in the press mold. The heated blank may be rapidly cooled by circulation of the refrigerant supplied through the cooling channel provided in the press mold. In this regard, in order to prevent a spring back phenomenon and maintain a desired shape of a plate material, the blank may be pressed and rapidly cooled while the press mold is closed. When molding and cooling the heated blank, the blank may be cooled with an average cooling rate of at least 10° C./s to a martensite end temperature. The blank may be held in the press mold for about 3 seconds to about 20 seconds. When a period of time for the blank being held in the press mold is less than 3 seconds, the material is not sufficiently cooled, and thus thermal deformation may occur due to residual heat of the product and variation in temperature of each portion, thereby causing deterioration in dimensional quality. Also, when the period of time for the blank being held in the press mold is more than 20 seconds, the time being held in the press mold is increased, thereby causing lower productivity.

In an embodiment, the hot-stamped part manufactured by the method of manufacturing a hot-stamped part described above may have a tensile strength of between about 500 MPa and 800 MPa, and may have a composite structure of ferrite and martensite. In some embodiments, the hot-stamped part manufactured by the method of manufacturing a hot-stamped part may have a tensile strength of between about 800 MPa and 1,200 MPa, and may have a composite structure of bainite and martensite. In some embodiments, the hot-stamped part manufactured by a method of manufacturing the hot-stamped part may have a tensile strength of between about 1.200 MPa and 2,000 MPa, and may have a structure of full martensite.

By simultaneously step heating the blanks having different thicknesses in the heating furnace, periods of time for the blanks to reach a target temperature (e.g., a soaking temperature) may be more precisely controlled. Because the periods of time for the blanks having different thicknesses to reach the target temperature (e.g., the soaking temperature) are more precisely controlled, hydrogen embrittlement, corrosion resistance, and weldability of the part manufactured by the method of manufacturing a hot-stamped part may be improved. In particular, when a thin material and a thick material are simultaneously heated in a single stage in the heating furnace, the thin material reaches a target temperature earlier than the thick material, and thus there may be some cases where the thin material is overheated. According to an embodiment of the present disclosure, even when the thin material and the thick material are simultaneously heated in the heating furnace, the thin material and the thick material are step heated, and thus periods of time for the thin material and the thick material to reach the target temperature (e.g., the soaking temperature) may be similarly controlled. Accordingly, as the periods of time for the thin material and the thick material to reach the target temperature (e.g., the soaking temperature) are similarly controlled, hydrogen embrittlement, corrosion resistance, and weldability of the part manufactured by the method of manufacturing a hot-stamped part may be improved.

Embodiment

A blank having an alloy composition shown in Table 1 is prepared. In a heating furnace set according to the standards of Table 2, temperatures for respective sections of Table 3 are set, and then hot-stamped parts are manufactured according to conditions of Comparative Examples 1 and 2, and Embodiment. The total length of the heating furnace is 22,400 mm.

TABLE 1

| Alloy component (wt %) | | | | | | | | | | |
|---|---|---|---|---|---|---|---|---|---|---|
| C | Si | Mn | P | S | Al | Cr | Mo | Ti | B | N |
| 0.23 | 0.24 | 1.17 | 0.014 | 0.002 | 0.03 | 0.18 | 0.002 | 0.03 | 0.003 | 0.0035 |

TABLE 2

| Section of Heating Furnace | First Section | Second Section | Third Section | Fourth Section | Fifth Section | Sixth Section | Seventh Section |
|---|---|---|---|---|---|---|---|
| Length of Heating Furnace | 1,600 mm | 2,800 mm | 3,200 mm | 4,400 mm | 4,000 mm | 4,000 mm | 2,000 mm |

TABLE 3

| Section of Heating Furnace | Temperature Set for Each Section of Heating Furnace | | | | | | | Heating Furnace Retention Time (Seconds) |
|---|---|---|---|---|---|---|---|---|
| | First Section | Second Section | Third Section | Fourth Section | Fifth Section | Sixth Section | Seventh Section | |
| Embodiment | 820° C. | 850° C. | 880° C. | 910° C. | 950° C. | 950° C. | 950° C. | 200 |
| Comparative Example 1 | Soaking at 950° C. | | | | | | | 200 |
| Comparative Example 2 | Soaking at 930° C. | | | | | | | 200 |

Referring to FIG. 3, a hot-stamped part (Embodiment) was manufactured using the method of manufacturing a hot-stamped part according to an embodiment, and in the cases of Comparative Examples 1 and 2, hot-stamped parts were manufactured by soaking blanks at temperatures of 950° C. and 930° C., respectively.

Hydrogen embrittlement evaluation, corrosion resistance evaluation, and weldability evaluation were performed on parts manufactured according to the conditions of Embodiment, Comparative Example 1, and Comparative Example 2.

1. Hydrogen Embrittlement Evaluation

For the parts manufactured according to the conditions of Embodiment, Comparative Example 1, and Comparative Example 2, hydrogen embrittlement was evaluated using thermal desorption spectroscopy (TDS) equipment according to ISO16573-2015 regulations. That is, in a vacuum atmosphere, the parts manufactured according to the conditions of Embodiment, Comparative Example 1, and Comparative Example 2 were each heated to measure the amount of diffusion hydrogen emitted from the parts at 300° C. or less.

Figure 8:
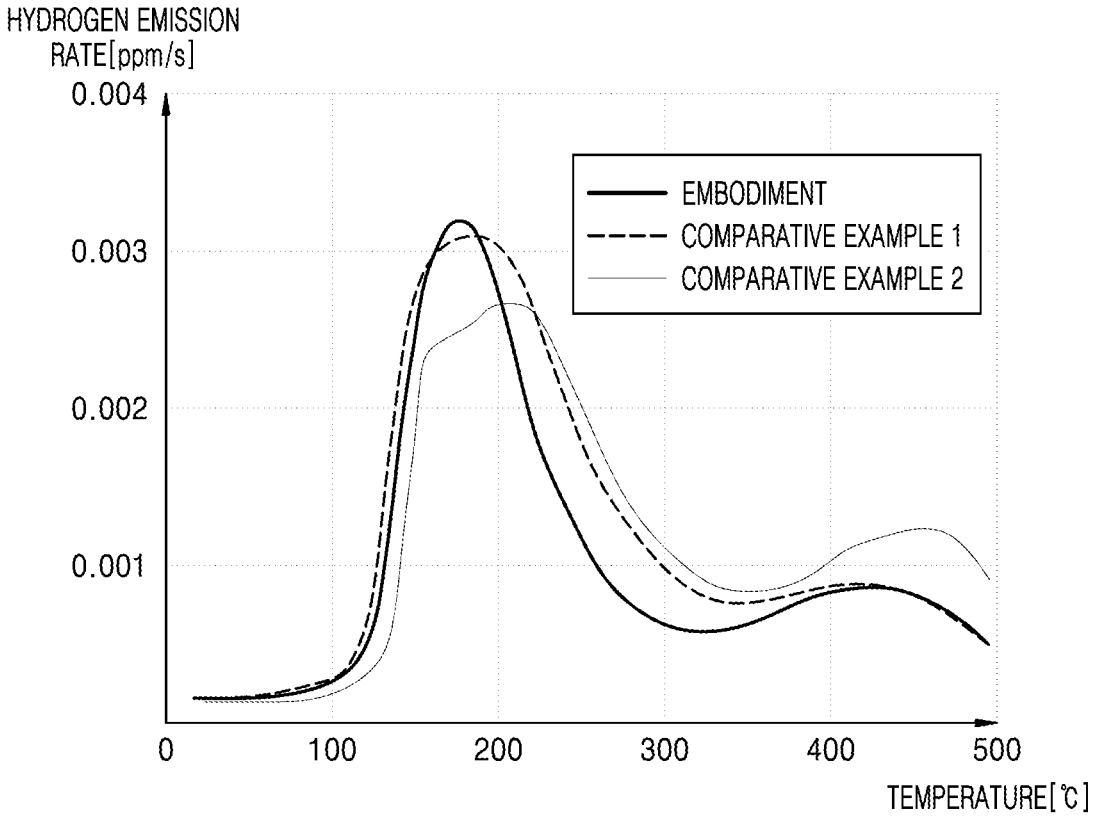
FIG. 8 is a graph of emission rates of hydrogen emitted from parts manufactured according to conditions of Embodiment, Comparative Example 1, and Comparative Example 2.

FIG. 8 is a graph of emission rates of hydrogen emitted from parts manufactured according to conditions of Embodiment, Comparative Example 1, and Comparative Example 2, and Table 4 illustrates a result of calculating the amount of diffusion hydrogen at 300° C. or less and a result of an experiment on delayed fracture, based on the result of hydrogen emission rates of Embodiment, Comparative Example 1, and Comparative Example 2.

TABLE 4

| | Amount of diffusion hydrogen | Result of Experiment on Delayed Fracture |
|---|---|---|
| Embodiment | 0.412 ppm | Non-fractured |
| Comparative Example 1 | 0.531 ppm | Fractured |
| Comparative Example 2 | 0.475 ppm | Fractured |

Referring to FIG. 8 and Table 4, it may be seen that, in the case of Embodiment, the amount of diffusion hydrogen at 300° C. or less is 0.412 ppm, in the case of Comparative Example 1, the amount of diffusion hydrogen at 300° C. or less is 0.531 ppm, and in the case of Comparative Example 2 at 300° C. or less is 0.475 ppm. Also, as the result of experiment on delayed fracture, it may be seen that, in the cases of Comparative Examples 1 and 2, delayed fracture occurs, and in the case of Embodiment, delayed fracture does not occur. Because the hot-stamped part manufactured through step heating has the least amount of diffusion hydrogen and is unlikely to have delayed fracture, hydrogen embrittlement of the hot-stamped part may be reduced when step heating is used.

2. Corrosion Resistance Evaluation

For the hot-stamped parts manufactured according to the conditions of Embodiment, Comparative Example 1, and Comparative Example 2, corrosion resistance was evaluated according to ASTM G59-97(2014) standards. In particular, for an experiment on corrosion resistance evaluation, three-electrode electrochemical cell was constructed by using a working electrode as a specimen, a high-purity carbon rod as a counter electrode, a saturated calomel electrode as a reference electrode, to carry out a copper potential polarization test. The copper potential polarization test was carried out after verifying electrochemical stabilization by measuring an open-circuit potential (OCP) in a 3.5% sodium chloride (NaCl) solution for 10 hours, and the experiment on corrosion resistance evaluation was conducted by applying a potential from about −250 mVSCE to about 0 mVSCE based on a corrosion potential (Ecorr) at a scanning rate of 0.166 mV/s.

Figure 9:
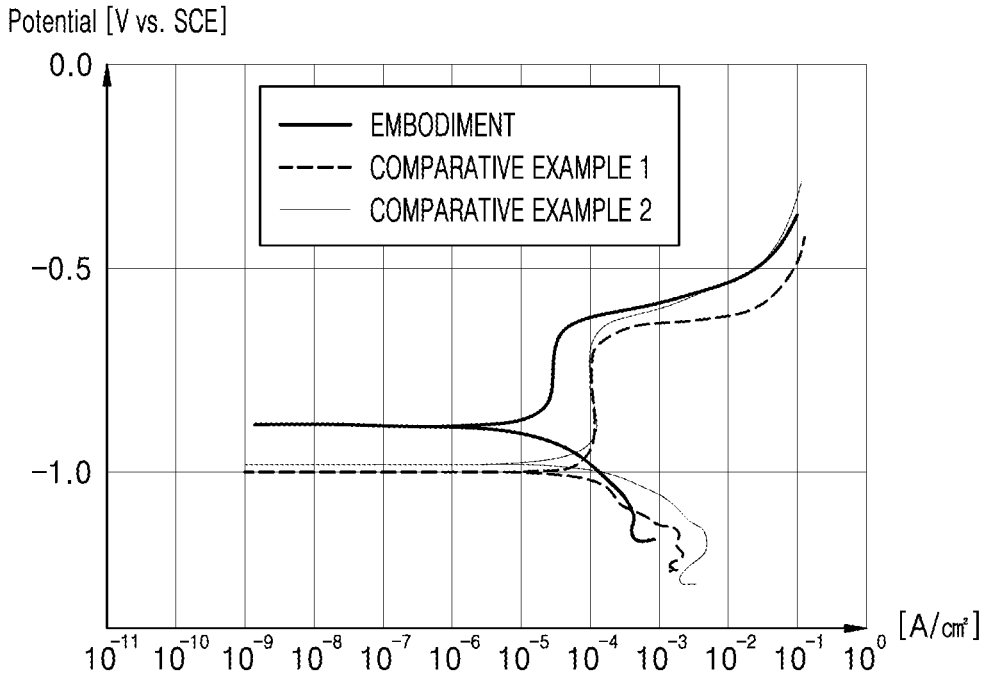
FIG. 9 is a graph of a result of corrosion resistance evaluation for parts manufactured according to Embodiment, Comparative Example 1, and Comparative Example 2.

FIG. 9 is a graph of a result of corrosion resistance evaluation for parts manufactured according to Embodiment, Comparative Example 1, and Comparative Example 2, and Table 5 is obtained by calculating corrosion rates of parts manufactured according to Embodiment, Comparative Example 1, and Comparative Example 2 based on polarization curves of FIG. 9. In this regard, the corrosion rates of FIG. 5 are values each corresponding to the current density at a point in time when a stably maintained potential is branched off in polarization curves of Embodiment, Comparative Example 1, and Comparative Example 2.

TABLE 5

| | Corrosion Rate |
|---|---|
| Embodiment | $2.805 \times 10^{-6}$A |
| Comparative Example 1 | $3.109 \times 10^{-5}$A |
| Comparative Example 2 | $1.979 \times 10^{-5}$A |

Referring to FIG. 9 and Table 5, in the cases of Comparative Examples 1 and 2, the lower a soaking temperature, the lower a corrosion rate, so that excellent corrosion resistance is exhibited. However, it may be seen that, when step heating is used as in the case of Embodiment, more excellent corrosion resistance may be secured as compared to the use of single-stage heating(soaking).

3. Weldability Evaluation

Weldability evaluation was conducted on the parts manufactured according to Embodiment, Comparative Example 1, and Comparative Example 2. In the weldability evaluation, the parts manufactured according to the conditions of Embodiment, Comparative Example 1, and Comparative Example 2 were each prepared in a pair, and were spot-welded while applying a pressure of 350 kgf and a current of 5.5 kA thereto using an electrode rod formed of chrome-copper alloy having a diameter of 6 mm. Resistance was measured while performing the spot-welding.

In general, a change in resistance value up to 30 ms in an initial stage determines the occurrence of spatter and weldability characteristics, and the lower the resistance, the more excellent the weldability.

Figure 10:
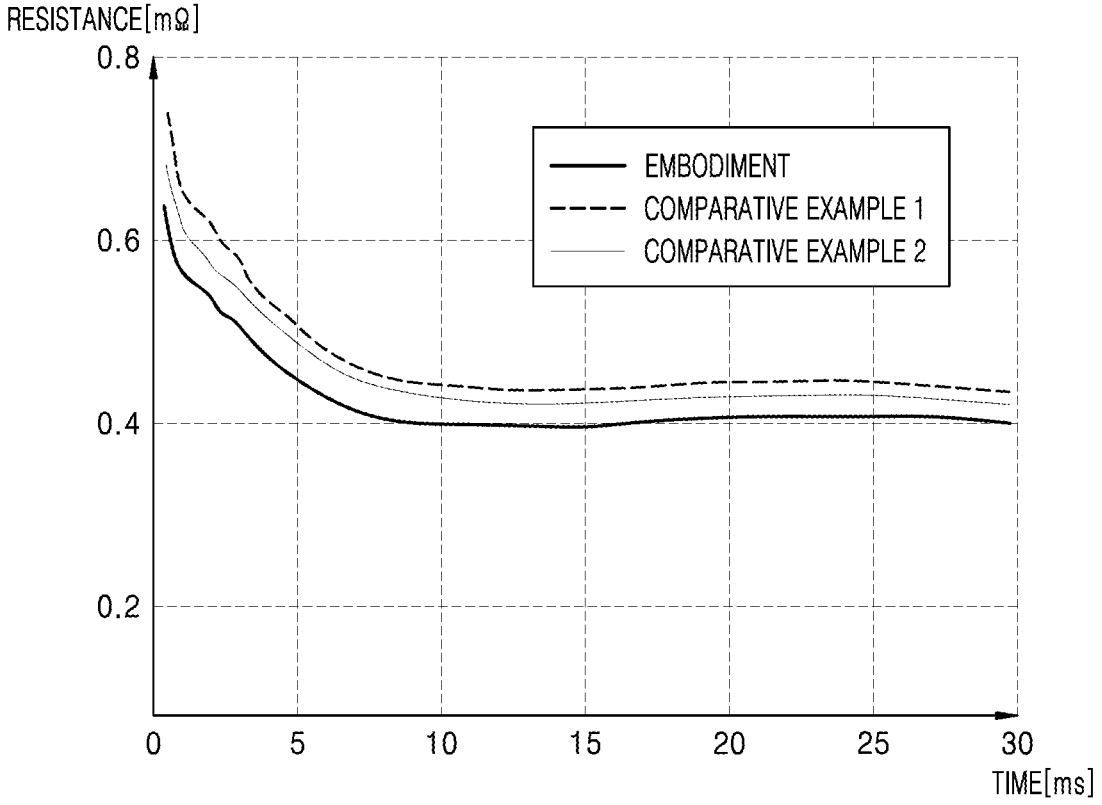
FIG. 10 is a graph of resistance values for parts manufactured according to Embodiment. Comparative Example 1, and Comparative Example 2.

FIG. 10 is a graph of resistance values for parts manufactured according to Embodiment, Comparative Example 1, and Comparative Example 2. Referring to FIG. 10, it may be seen that a hot-stamped part (Embodiment) manufactured through step heating has lower resistance compared to a hot-stamped part (Comparative Example 1) manufactured through soaking at a temperature of 950° C., and a hot-stamped part (Comparative Example 2) manufactured through soaking at a temperature of 930° C. Therefore, it may be verified that the weldability of the hot-stamped part (Embodiment) manufactured through step heating is relatively excellent compared to the hot-stamped part (Comparative Example 1) manufactured through soaking at a temperature of 950° C. and the hot-stamped part (Comparative Example 2) manufactured through soaking at a temperature of 930° C.

According to the embodiments of the present disclosure, by step heating the blanks in the heating furnace including the sections with different temperature ranges, periods of time for the blanks to reach the soaking temperature may be more precisely controlled.

Also, because the periods of time for the blanks having different thicknesses to reach the soaking temperature are more precisely controlled, hydrogen embrittlement, corrosion resistance, and weldability of the part manufactured by the method of manufacturing a hot-stamped part may be improved.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

What is claimed is:

1. A hot-stamped part manufactured by a manufacturing method wherein the manufacturing method comprises inserting a blank into a heating furnace, wherein the heating furnace includes heating sections and soaking sections, step heating the blank as the blank passes through the heating sections, and soaking the blank at a temperature of Ac3 to 1,000° C. as the blank passes through the soaking sections;

wherein, in the step heating of the blank, a temperature condition in the heating furnace satisfies formula:

$$0<(Tg-Ti)/Lt<0.025° C./mm$$

wherein Tg denotes a soaking temperature (° C.), Ti denotes an initial temperature (° C.) of the heating furnace, and Lt denotes a total length (mm) of the heating sections, wherein an amount of diffusion hydrogen of the hot-stamped part is less than 0.45 ppm, and wherein a corrosion rate of the hot-stamped part measured through a copper potential polarization test is less than or equal to $3\times10^{-6}$ A.

2. The hot-stamped part of claim 1, having a tensile strength of between 500 MPa and 800 MPa, and having a composite structure of ferrite and martensite.

3. The hot-stamped part of claim 1, having a tensile strength of between 800 MPa and 1,200 MPa, and having a composite structure of bainite and martensite.

4. The hot-stamped part of claim 1, having a tensile strength of between 1,200 MPa and 2,000 MPa, and having a composite structure of full martensite.

* * * * *